United States Patent [19]

Schmittle et al.

[11] 4,074,753

[45] Feb. 21, 1978

[54] HEAT TRANSFER IN POOL BOILING

[75] Inventors: Karl V. Schmittle; Keith E. Starner, both of York, Pa.

[73] Assignee: Borg-Warner Corporation, Chicago, Ill.

[21] Appl. No.: 707,974

[22] Filed: July 23, 1976

Related U.S. Application Data

[62] Division of Ser. No. 538,234, Jan. 2, 1975, abandoned.

[51] Int. Cl.[2] ..... F28F 13/02; F28F 1/36

[52] U.S. Cl. ..... 165/184; 62/527

[58] Field of Search ..... 62/527; 165/133, 184

[56] References Cited

U.S. PATENT DOCUMENTS

| | | | |
|---|---|---|---|
| 496,757 | 5/1893 | Theisen | 165/184 |
| 927,702 | 7/1909 | Zent | 165/184 |
| 2,310,970 | 2/1943 | Limpert | 165/184 X |
| 2,453,448 | 11/1948 | McTurk | 165/184 |
| 3,162,244 | 12/1964 | Wambo | 165/184 |
| 3,521,708 | 7/1970 | Webb | 165/133 X |
| 3,555,845 | 1/1971 | Huelle | 62/527 X |
| 3,587,730 | 6/1971 | Milton | 62/527 X |

FOREIGN PATENT DOCUMENTS

| | | | |
|---|---|---|---|
| 3,664 of | 1894 | United Kingdom | 165/184 |
| 767,963 | 2/1957 | United Kingdom | 165/133 |

*Primary Examiner*—Charles J. Myhre
*Assistant Examiner*—Sheldon Richter
*Attorney, Agent, or Firm*—Thomas B. Hunter

[57] ABSTRACT

A heat transfer surface for use in a flooded evaporator. In a preferred embodiment, a fibrous material is wrapped on the surface of a tubular heat exchange member so that the strands of material lie in spaced relation so as not to blanket the entire surface but rather to provide a good distribution of nucleation sites over the tube surface.

2 Claims, 6 Drawing Figures

HEAT TRANSFER IN POOL BOILING

This is a division of application Ser. No. 538,234 filed Jan. 2, 1975, now abandoned.

BACKGROUND OF THE INVENTION

1. Field of the Invention

Nucleate boiling enhancement, especially in flooded liquid chillers using a halocarbon refrigerant.

2. Description of the Prior Art

Various techniques have been employed to enhance the formation of nucleate boiling in flooded evaporators such as those comprising a tube bundle immersed in a halocarbon refrigerant such as R-12 or R-11. Examples of such techniques include scoring or artificially roughing the tube surface, providing a sintered, porous surface coating as described in U.S. Pat. No. 3,384,154; using bent over fins to provide re-entrant cavities such as described in U.S. Pat. No. 3,454,081; and the use of inserts between the spaced fin surfaces as described in U.S. Pat. No. 3,521,708, issued to R. L. Webb on July 28, 1970. In Webb, radially extending fins are first formed in a conventional manner, such as by commercial finning equipment; and then the space between adjacent fins is wrapped with a solid, homogenous insert to produce a narrow gap between the insert and the fin surface.

SUMMARY OF THE INVENTION

In the present invention, it has been found that nucleate boiling may be further enhanced by wrapping either a plain tube with a fibrous or stranded material or by substituting a fibrous or stranded insert on a finned tube for the solid wrap material shown in Webb.

DETAILED DESCRIPTION OF THE INVENTION

Figure 1:
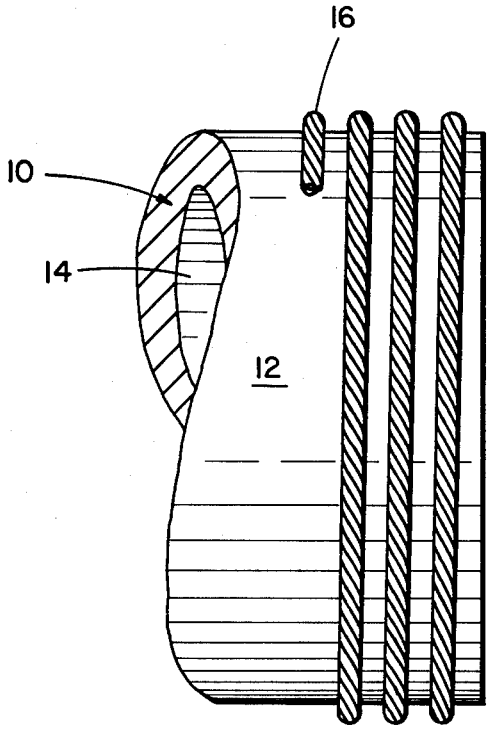
FIG. 1 is a front elevation view, with certain portions being broken away for clarity, of a tube wrapped with a fibrous nucleate boiling enhancing material in accordance with a preferred embodiment of the invention.
Figure 2:
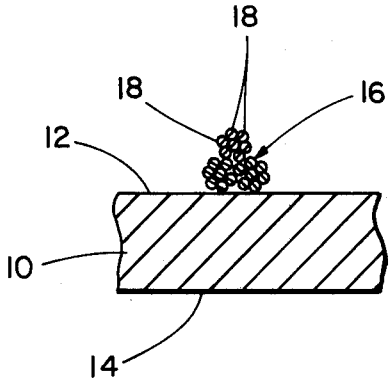
FIG. 2 is a detailed cross-section view taken adjacent the fin surface.

FIGS. 1 and 2 illustrate a preferred embodiment of the invention including a tube 10 through which a heat exchange medium, such as water, is circulated to and from the refrigeration load. It is understood that the outside surface 12 of tube 10 is adapted to be arranged within an evaporator (not shown) such that the body of refrigerant covers substantially the entire surface thereof. Under the conditions existing in the evaporator, the heat exchange medium flowing through tube 10 is warm enough to create boiling at the surface 12, thereby abstracting heat through the tube wall from the water flowing to the load. Overall heat transfer is a function of (1) the heat transfer at the inner surface 14 of the tube, between the tube and the water, (2) the heat transfer through the tube wall, and (3) the heat transfer at surface 12 between the tube and the refrigerant.

It is well-known that the creation of nucleate boiling sites is a major factor in the heat transfer coefficient between the refrigerant and the tube surface. The more active boiling sites on the tube, the greater the heat transfer. In the present invention, the plain tube surface 12 is wrapped with a fibrous material 16 composed of a plurality of individual strands 18 (FIG. 2) formed together in a strand bundle as a thread or "rope". The material from which the wrap is made should, of course, be substantially imperveous to the refrigerant environment in which it is located and should have a relatively rough surface texture to promote nucleate boiling at the contact point where it engages the tube surface 12. Various natural and artificial fibers may be employed. For example, one material which has been found to be suitable is nylon. Other materials which may be usful are polyester, rayon, and cotton. In a preferred embodiment, the spacing(s) on the plain, nonfinned tube is about approximately 0.01 inch and the diameter of the fibrous cord wrap is about 0.01 to 0.02 inch.

In one example, a plain copper tube was wrapped with a nylon thread comprising three bundles of filaments interwined or braided in a rope-like manner. The overall "rope" diameter was about 0.015 inch; each of the three bundles was about 0.0075 inch in diameter; and the individual filaments were about 0.001 inch in diameter.

Figure 3:
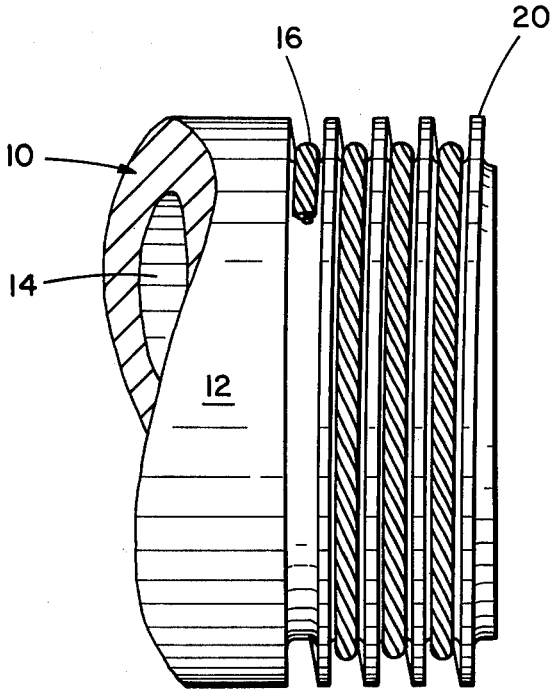
FIG. 3 is a modified embodiment of the invention showing a fibrous insert on a finned tube.
Figure 4:
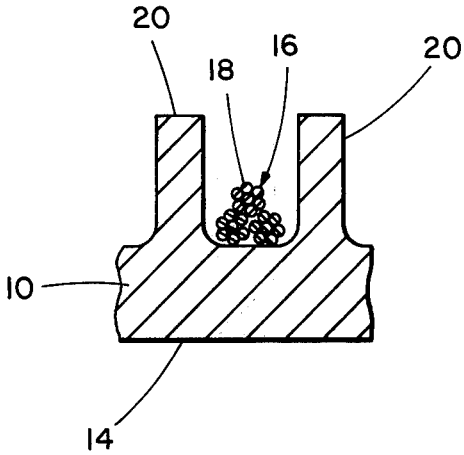
FIG. 4 is a detailed cross-section view, similar to FIG. 2, of the embodiment shown in FIG. 3.

In another embodiment of the invention, shown in FIGS. 3 and 4, the wrap is placed around a finned tube 10 which is provided with conventional helically formed integral fins 20. The tube may be wrapped with a single turn between each fin, as shown, or with multiple turns, the number being dependent on fin spacing. The wrap 16 is the same type of material previously described in connection with FIGS. 1 and 2.

Figure 5:
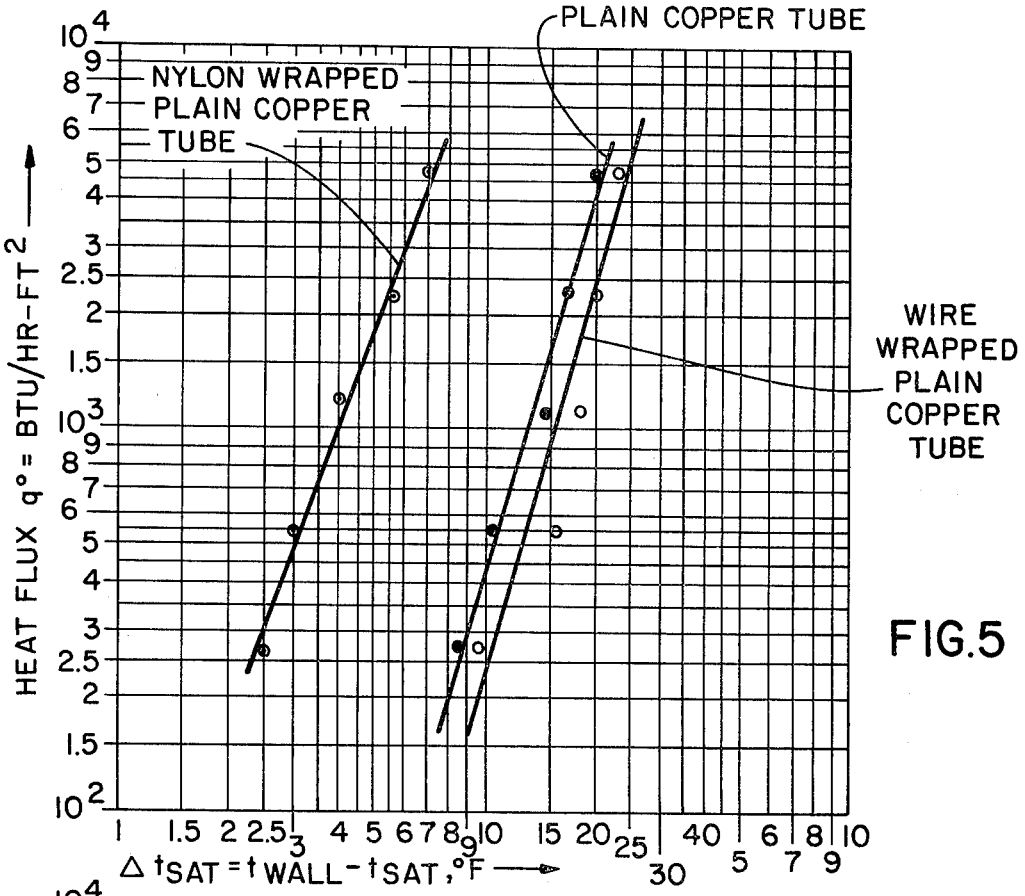
FIG. 5 is a graph in which heat flux is plotted against $\Delta T$ for a plain copper tube.
Figure 6:
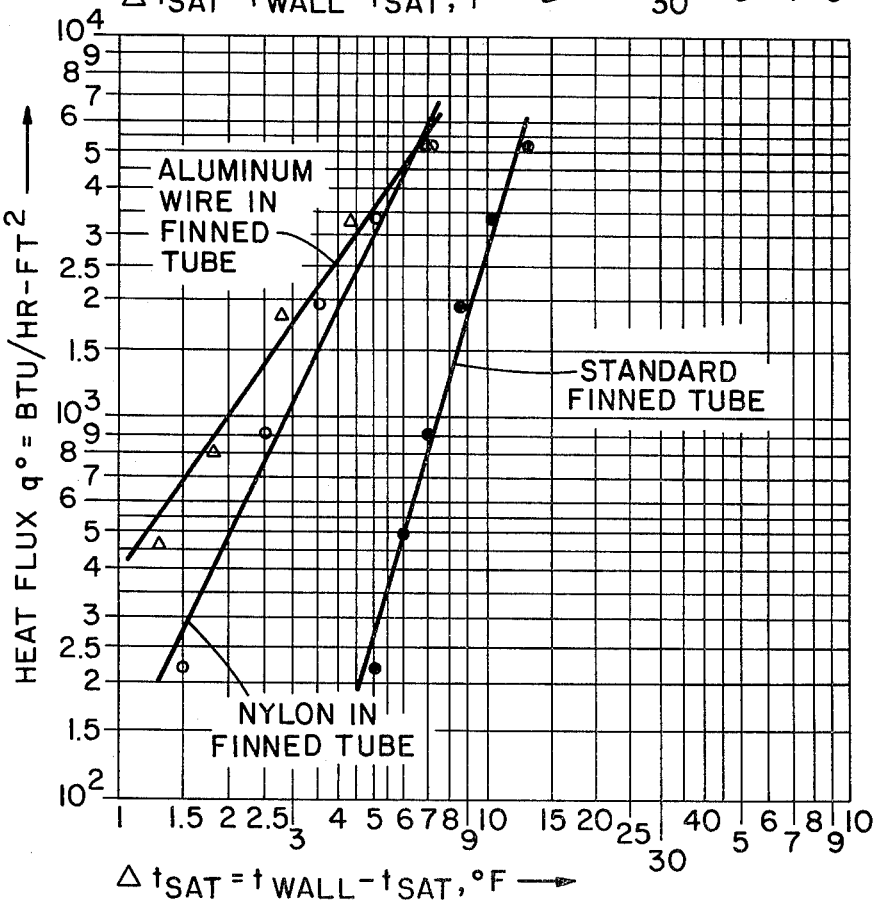
FIG. 6 is a graph, similar to FIG. 5, for an integrally finned tube.

FIGS. 5 and 6 illustrate the relative pool boiling efficiency (refrigerant R-11 at 1 atmosphere) of the present invention for plain and finned copper tubes. In FIG. 5, the plots compare the boiling efficiency of a wrapped $\frac{3}{4}$ plain copper tube with that of an unwrapped copper tube of the same diameter. The wrap consisted of a length of funicular material in the form of nylon "rope" of the size and type discussed above. It can be seen that greater heat flux is achieved with smaller $\Delta T$'s for the wrapped tube as compared with the plain tube. Also shown in FIG. 5 is a plot for a $\frac{3}{4}$ copper tube which has been wrapped with copper wire, of about the same overall diameter as the nylon, in the manner described in Webb U.S. Pat. No. 3,521,708. The wire wrapped tube actually shows a small decrease in performance as compared to the plain tube. As used in this specification, the term funicular is intended to have its standard dictionary meaning: "having the form of or associated with a cord".

In order to compare the performance of the nylon wrap on a finned tube with the general teachings in Webb, a finned tube was also tested in refrigerant R-11 at one atmosphere. As shown in FIG. 6, a finned tube having a double wrap of nylon cord (of the same type discussed in previous examples) was tested against an aluminum wire wrapped finned tube. The tube was $\frac{3}{4}$ O.D. and had 19 fins/inch. In the case of the wire wrapped tube, the gap between the adjacent turns was 0.002 inch.

The results indicate that the performance of the wire wrapped tube was slightly better than the nylon wrapped sample. However, the fact that the wire wrapped tube is totally ineffective in a plain tube application where the nylon wrapped tube is very effective indicates that there is an entirely different phenomenon involved with nylon wrap on the plain tube and this same phenomenon is undoubtedly present on the nylon wrapped finned tube. In any event, the results for the finned tube show almost as good heat transfer can be achieved using an inexpensive nylon wrap as the relatively more expensive wire of Webb.

While this invention has been described in connection with certain embodiments thereof, it is understood that this is by way of illustration and not by way of limitation; and the scope of the appended claims should be construed as broadly as the prior art will permit.

What is claimed is:

1. In a heat exchanger adapted for use in a pool boiling application wherein a relatively low boiling point liquid is caused to boil on the outside surface of a plurality of heat exchange tubes totally immersed in said liquid, each said tube comprising an elongated, tubular metal substrate and a length of fibrous, multifilament funicular material spirally wound on the outside surface of said substrate, the spacing between adjacent turns being approximately 0.01 inch, said funicular material having an outer diameter between 0.01 and 0.02 inches.

2. The combination as defined in claim 1 wherein said fibrous material is selected from the group consisting of nylon, polyester, rayon and cotton.

* * * * *